US006287154B1

(12) United States Patent
Palmer et al.

(10) Patent No.: US 6,287,154 B1
(45) Date of Patent: Sep. 11, 2001

(54) CONTACT TERMINAL ARRANGEMENT FOR ELECTRICAL BUILT-IN SWITCHING UNIT

(75) Inventors: Andrew Joseph Palmer, Tauranga; Mark Ronald Graves, Mount Maunganui; Ian David Cochrane, Tauranga, all of (NZ)

(73) Assignee: Invensys, plc, Foxboro, MA (US)

( * ) Notice: Subject to any disclaimer, the term of this patent is extended or adjusted under 35 U.S.C. 154(b) by 0 days.

(21) Appl. No.: 09/355,093

(22) PCT Filed: Jan. 21, 1998

(86) PCT No.: PCT/NL98/00002

§ 371 Date: Oct. 25, 1999

§ 102(e) Date: Oct. 25, 1999

(87) PCT Pub. No.: WO98/32143

PCT Pub. Date: Jul. 23, 1998

(30) Foreign Application Priority Data

Jan. 21, 1997 (NL) ..... 314095

(51) Int. Cl.[7] ..... H01R 13/432
(52) U.S. Cl. ..... 439/747
(58) Field of Search ..... 439/746, 747, 439/733.1; 336/192; 200/11 D, 11 G, 568

(56) References Cited

U.S. PATENT DOCUMENTS

| | | | | |
|---|---|---|---|---|
| 2,039,957 | * | 5/1936 | Hall | 200/11 D |
| 2,064,157 | * | 12/1936 | Frnaklin | 200/568 |
| 2,988,606 | * | 6/1961 | Allison | 200/11 D |
| 2,994,748 | * | 8/1961 | Long | 200/11 G |
| 3,566,322 | * | 2/1971 | Horbach | 336/192 |
| 5,008,644 | * | 4/1991 | Cooper | 336/192 |

* cited by examiner

*Primary Examiner*—Neil Abrams
*Assistant Examiner*—Hu Dinh
(74) *Attorney, Agent, or Firm*—Terrence Martin; Sampson & Associates

(57) ABSTRACT

An electrical device (20), in particular an energy regulator or infinite switch, comprises a body portion (22) with one or more electrical elements (33, D, B, C, 47) mounted thereto. The body portion (22) and the electrical element(s) (33, D, B, C, 47) mounted thereto define an assembly having a minimum dimension which is termed the "thickness" of the assembly. At least one terminal (25, 57, 58, 59, 60, 61, 63) is also mounted to the body portion. The terminal has a mounting portion (27) and a contact portion (26) with the mounting portion (27) extending transversely to the thickness dimension to thereby result in a low-profile electrical device.

22 Claims, 5 Drawing Sheets

CONTACT TERMINAL ARRANGEMENT FOR ELECTRICAL BUILT-IN SWITCHING UNIT

TECHNICAL FIELD

The present invention relates to terminal arrangements provided in electrical devices. In particular, although not exclusively, the invention relates to low profile control devices for electrical appliances such as hot plates in electric stoves. However, it will be appreciated that the use of such a device is not restricted to domestic appliances.

BACKGROUND ART

Control devices, commonly known as energy regulators or infinite switches are used primarily in domestic appliances where it is required to control heating of an element in an oven or a hot plate. The control devices allow electricity through to the elements in pulses and it will be appreciated that longer pulses will lead to higher element temperatures. The length of these pulses can be lengthened or shortened by turning a knob on the control device so as to increase or decrease the element temperature. The knob is attached to an actuator shaft which is generally mounted perpendicular to a mounting plate which also supports a terminal housing. A number of electrical terminals are assembled into the terminal housing by sliding mounting portions of the terminals into slots in the housing extending in a direction perpendicular to the general plane of the mounting plate, i.e. parallel to the actuator shaft. (See FIG. 1) The terminals may be staked to retain them in position.

There are a number of disadvantages inherent in this type of construction. Firstly, the construction requires the use of a separate mounting plate and housing. Secondly, the sliding of the terminals perpendicularly to the mounting plate to assemble the control device necessitates an overall depth of the device which is greater than the length of the terminals since the mounting portions of the terminals extend into slots aligned with the lengthwise direction of the terminals. The staking of the terminals is also an additional assembly step increasing the number of assembly operations.

It is therefore an object of the present invention to overcome at least one of the abovementioned disadvantages or to provide the public with a useful choice.

DISCLOSURE OF INVENTION

In accordance with a first aspect of the present invention, there is provided an electrical device including: a body portion; one or more electrical elements mounted to the body portion, the body portion and the one or more electrical elements defining an assembly having a thickness dimension which is the minimum external (or principal) dimension of the assembly; and at least one electrical terminal mounted to the body portion, the electrical terminal having a mounting portion and a contact portion, the mounting portion extending transversely to the direction of the thickness dimension and being received in a recess extending from the side of the body portion, which side is substantially aligned with the thickness dimension, the mounting portion being adapted for sliding assembly into the recess.

Preferably, the mounting portion extends substantially perpendicular to the direction of the thickness dimension. For example, the mounting portion may extend in either of the two orthogonal directions perpendicular to the thickness dimension, parallel to the general plane of the body portion so as not to contribute to the overall thickness of the electrical device. The mounting portion may be a planar member oriented such that the thickness dimension extends substantially perpendicular to the plane of the mounting portion. Further, it is preferred that the contact portion of the electrical terminal has a substantially planar contact surface which is substantially aligned with the thickness dimension. In a most preferred form of the invention the contact portion of the electrical terminals does not extend substantially beyond the thickness dimension. Thus, in the preferred form of the invention the terminal may be an L-shaped member whereby the mounting portion and the contact portion define respective leg portions of the L-shaped member.

Suitably, the terminal is disposed at or adjacent a side of the body portion which is substantially aligned with the thickness dimension. A slot may be provided at the side of the body portion, the slot being complementary in shape to the mounting portion of the terminal and the mounting portion of the terminal being received in the slot.

Advantageously, a frictional fit is provided between the mounting portion of the terminal and the body portion. Alternatively, a snap fit is provided between the mounting portion of the terminal and the body portion.

Preferably, the body portion is substantially planar. In a preferred form of the invention, a plurality of terminals are provided and the electrical element(s) and the terminals are mounted to extend from the same face of the body portion. The device may further include a rotary control actuator mounted to extend from the other face of the body portion in a direction substantially aligned with the thickness dimension.

In a commercial embodiment of the invention, the body portion is of a one-piece plastic moulded construction.

In accordance with a second aspect of the present invention, there is provided a control device for an electrical appliance, including at least one electrical terminal and a substantially planar body portion, the electrical terminal being adapted for sliding assembly with the body portion in a direction substantially parallel to the plane of the body portion into a recess extending substantially parallel to the plane of the body portion.

By "substantially planar", it is meant that the body portion extends largely within a single plane with an average thickness dimension transverse to the plane being substantially less than the extent of the body portion within the plane.

Suitably, there are a plurality of electrical terminals assembled in this manner in the body portion. Each of the electrical terminals may include a mounting portion extending substantially parallel to the plane of the body portion and a contact portion extending substantially perpendicular thereto. The recesses may be in the form of slots, apertures or recesses and desirably a frictional fit is obtained between each electrical terminal and its respective receiving means.

In a preferred form of the invention, a control actuator is also mounted to the body portion with the control actuator having a longitudinal axis extending substantially perpendicular to the plane of the body portion. In a most preferred form of the invention, the body portion is in the form of a one piece moulded mounting plate with the receiving slots integrally formed in the mounting plate.

The control device may take the form of an energy regulator (infinite switch) incorporating a bimetallic switch and intended to be used in a domestic appliance. The body portion may be located behind a face plate provided on the electrical appliance.

In accordance with a third aspect of the present invention, there is provided a control device for an electrical appliance including at least one electrical terminal and a control actuator having a longitudinal axis wherein the electrical terminal is adapted for sliding assembly in the control device in a direction substantially perpendicular to the axis of the control actuator into a recess substantially perpendicular to the axis of the control actuator.

Preferably, a body portion is provided into which the electrical terminals may be slidably received during assembly. Suitably, the control actuator may take the form of an actuator shaft to which an actuator knob can be fitted, the longitudinal axis of the actuator shaft defining the longitudinal axis of the control actuator.

In order that the invention may be more readily understood, one embodiment will now be described with reference to the drawings in which:

BEST MODE FOR CARRYING OUT THE INVENTION

Figure 1:
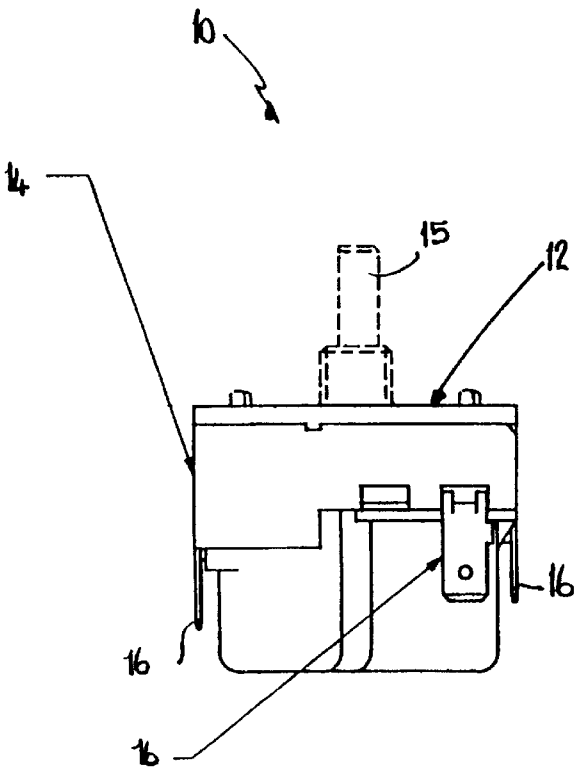
FIG. 1 (Prior Art)
FIG. 1 is a side view of a typical energy regulator according to the prior art.

In FIG. 1, the prior art energy regulator 10 is shown to comprise a mounting plate 12 and a separate terminal housing 14. A control actuator, including a control shaft 15 is mounted to the mounting plate 12 and terminal housing 14. A number of electrical terminals 16 are shown which are staked or clipped in through slots in the housing 14, the slots extending perpendicularly to the plane of the mounting plate 12. It can be seen that the provision of slots in the terminal housing 14 which are aligned with the longitudinal direction of the electrical terminals 16 leads to excess bulk of the regulator 10, particularly in the direction aligned with the axis of the control actuator 15. Typically, this dimension is 25 to 50 mm as shown in the figure.

Figure 2:
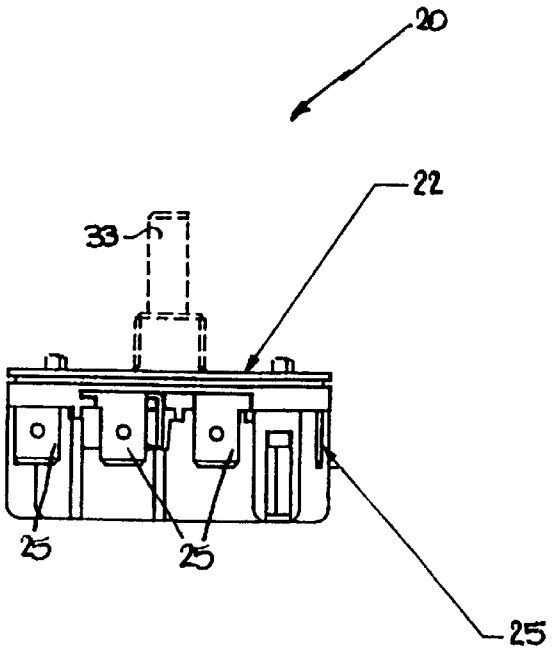
FIG. 2 is a side view of an energy regulator according to a preferred embodiment of the present invention.

FIG. 2 illustrates an energy regulator 20 according to the preferred embodiment of the present invention. The mounting plate and the terminal housing are combined into a moulded plastic one piece body portion 22 which is substantially planar apart from the boss for the mounting of the rotary control knob. The arrow indicates the general direction of the plane. With electrical elements mounted to one face of the body portion 22, it will be appreciated that the thickness direction lies along any line perpendicular to this plane. A number of electrical terminals 25 are assembled with the one piece body portion 22 as shown in more detail in FIGS. 3 and 4.

Figure 3:
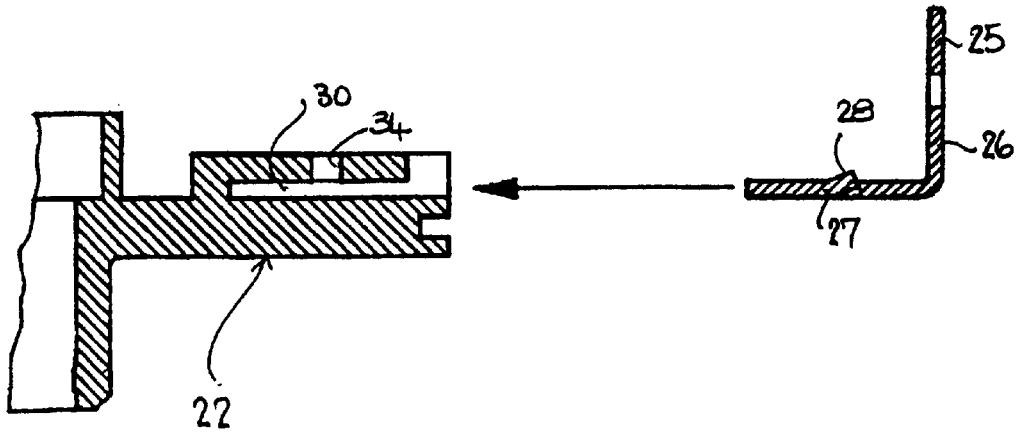
FIG. 3 is a cross sectional view of detail of a terminal of the energy regulator shown in FIG. 2 is in unassembled configuration.
Figure 4:
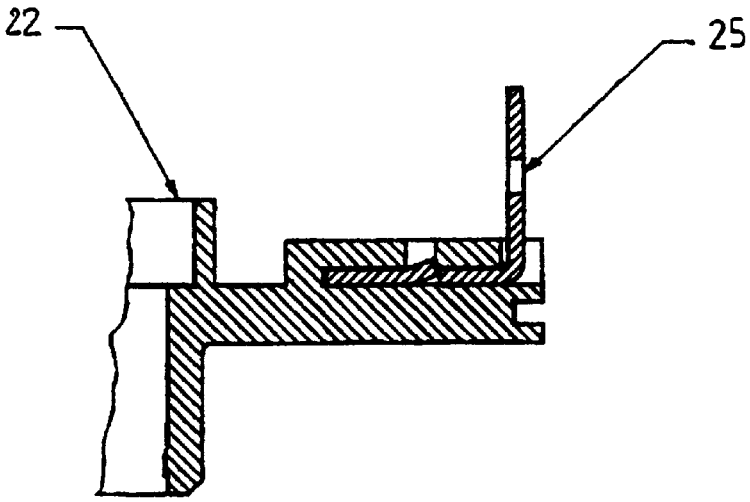
FIG. 4 is a detail similar to FIG. 3 except in assembled configuration.

Each of FIGS. 3 and 4 shows a partial section through the body portion 22 and a section through one of the electrical terminals 25. It can be seen that the electrical terminal 25 comprises a first contact portion 26 for making electrical contact with electrical components when the energy regulator 20 is installed into an electrical appliance (not shown). The electrical terminal 25 also comprises a second mounting portion 27 extending transversely, in particular, at right angles to the first contact portion 26. The mounting portion 27 is received by a cooperating receiving means 30 provided in one side of the body portion 22. The receiving means 30 is in the form of an elongate slot substantially complimentary to the shape of the mounting portion 27. In the assembled configuration, it can be seen that the mounting portion 27 and the receiving slot 30 extend in a direction substantially parallel to the general plane of the body portion 22, which is substantially perpendicular to the central longitudinal axis of the control actuator 33 (See FIG. 2) and the thickness direction of the body portion. This configuration with all the terminals 25 having mounting portions 27 extending substantially parallel to the plane of the body portion 22 substantially reduces the bulk of the energy regulator in the direction perpendicular to the plane of the body portion 22.

The mounting portion 27 is slidably receivable in the mounting slot 30 for easy assembly. A ramped projection 28 is provided on one face of the mounting portion 27 for retention within a further recess 34 provided in the body portion 22 to provide a snap fitting.

The energy regulator 20 is intended primarily for use in domestic appliances. The energy regulator 20 controls the heating of elements in ovens or hot plates by allowing electricity to pass through to the elements in pulses. The energy regulator 20 also controls the length of the pulses so as to increase or decrease the element temperature.

The energy regulator 20 incorporates a bimetallic switch 40 (FIGS. 5 and 6) to control the pulses of electricity between predetermined ones of electrical terminals 25. The bimetallic switch 40 is illustrated schematically in FIGS. 5 and 6.

Figure 10:
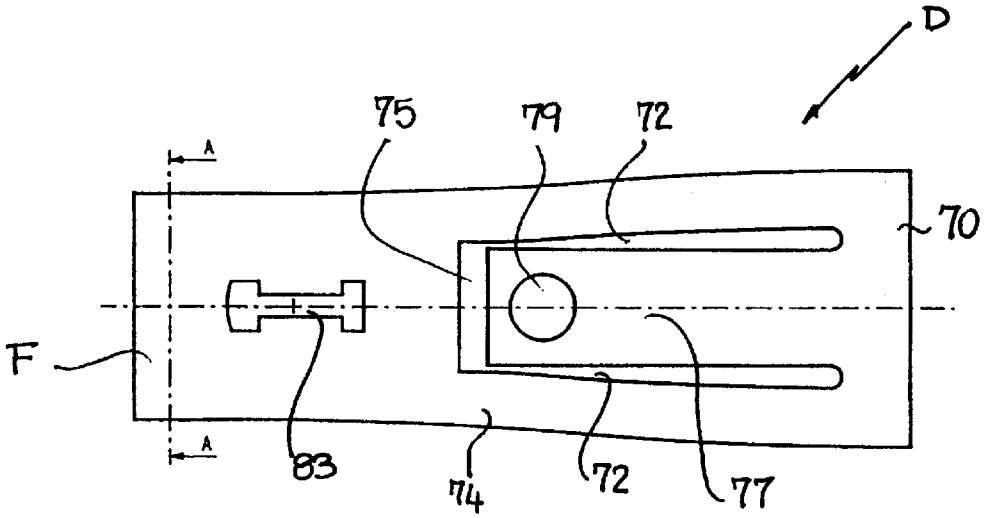
FIG. 10 is a plan view of a spring member for use in the bimetallic switch shown in FIG. 5.
Figure 11:
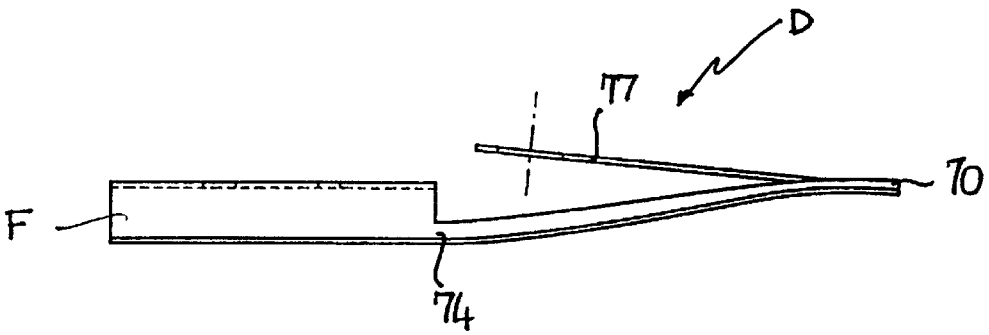
FIG. 11 is a side view of the spring member shown in FIG. 10.
Figure 12:
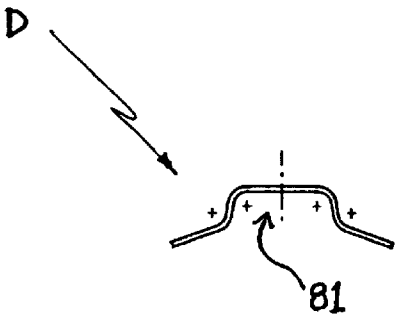
FIG. 12 is a cross-sectional view through A—A of FIG. 10.

The bimetallic switch 40 includes a bimetallic strip C anchored at one end indicated by A. A ceramic heating element B is disposed on the top surface of the bimetallic strip C. The bimetallic switch 40 also includes a spring member D, the form of which is more clearly shown in FIGS. 10 to 12. As can be seen from FIG. 5, the spring member D is anchored at a first end F and a variable load is applied by the bimetallic strip at a second end 70 opposite to the anchored end. The spring member D comprises a strip of spring metal with two spaced slots 72 both extending from a central portion 74 of the spring strip 77 towards the second end 70 but spaced from the second end. A transverse slot 75 connects the two parallel slots 72 to define an elongate contact portion 77 having a free end centrally disposed relative to the spring strip D. A first contact 79 is attached to the free end of the elongate contact portion 77. The bimetallic switch 40 also includes a second contact E engagable with the first contact when the switch 40 is in the closed position shown in FIG. 5.

It can be seen that the first end F has a longitudinal groove 81 extending to the central portion 74 which it is believed, assists in establishing residual stresses within the spring strip D. An additional slot 83 is provided adjacent the first end F to stake the spring member D to the Load Terminal 63 as will be discussed later in connection with FIGS. 8 and 9.

Figure 7:
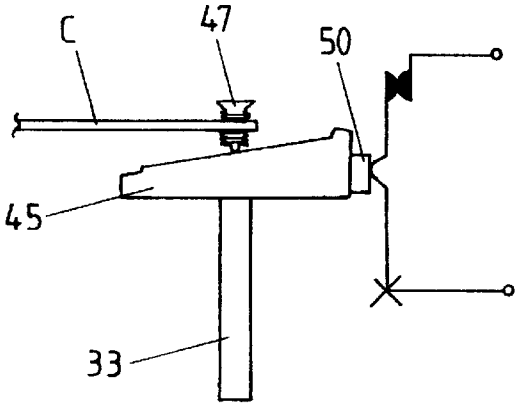
FIG. 7 schematically illustrates a control actuator for use in connection with the bimetallic switch shown in FIGS. 5 and 6.

The bimetallic strip C can apply a varying load to the second end of the spring strip. The varying load will depend upon the heating of the bimetallic strip which determines the configuration of the bimetallic strip as well as an initial bias applied by the control actuator 33, a portion of which is shown in FIG. 7.

The control actuator shaft 33 rotates a circular cam 45 which controls the location of a cam follower (calibration screw) 47 mounted to the bimetallic strip C.

The operation of the bimetallic switch will now be explained.

Figure 6:
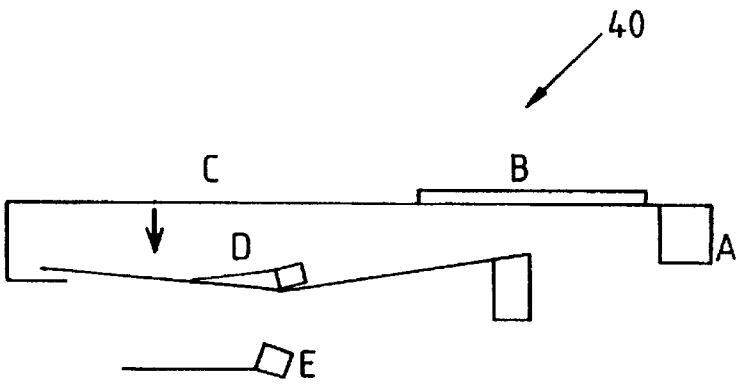
FIG. 6 is a schematic view, similar to that of FIG. 5 except with the switch in the off position.
Figure 5:
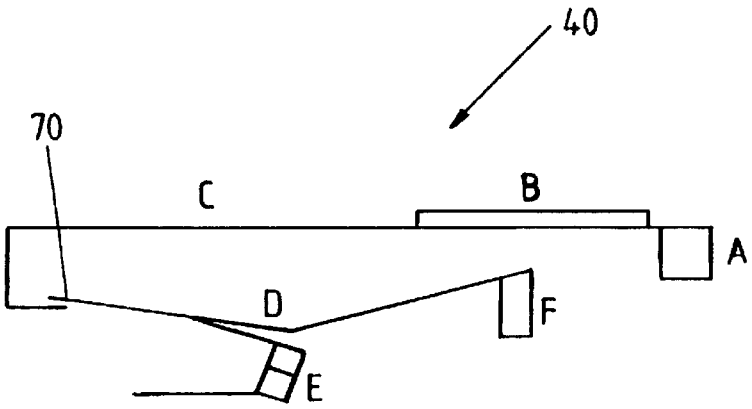
FIG. 5 is a schematic diagram illustrating the operation of a bimetallic switch incorporated into the energy regulator shown in FIG. 2, the bimetallic switch being shown in an operable position.

When the control actuator 33 is in the off position, the cam follower 47 engages with the lowest point on the circular ramp 45 and little or no bias is applied to the bimetallic strip. The contacts to the heater B are also open and thus little or no load is applied to the second end of the spring member D so that the first and second contacts are open as shown in FIG. 6. When the control actuator shaft 33 is rotated to an operating position, the cam follower 47 is raised, thereby applying an upward bias to the bimetallic strip C, which in turn applies a load to the second end of the spring member D to close the contacts as shown in FIG. 5. Electricity then flows through these contacts to the appliance elements. Electricity also flows through these contacts to the ceramic heater B which heats the bimetallic strip C which is configured to bend downwardly upon heating. This causes the contacts to open as shown in FIG. 6, whereupon current flow to the ceramic heater B and to the appliance element will cease and the bimetallic strip C will gradually cool to resume the configuration shown in FIG. 5, forcing the contacts to again close. This cycle of repeated opening and closing sends electricity through to the appliance elements in pulses. By rotating the control actuator 33 and increasing the upward bias on the bimetallic strip C, it will be necessary to heat the ceramic heater B for a longer period of time to cause the necessary deflection in the bimetallic strip C. Thus, the length of the pulses through to the appliance elements will be increased and the appliance elements will therefore be heated to a higher temperature.

When the control actuator shaft 33 is rotated to the "full on" position, a lobe on the circular ramp increases the bias to such an extent that the bimetallic strip applies a sufficient load to the spring member so that, irrespective of the deflection attained by the bimetallic strip, the contacts remain closed and the electricity flows continuously to the appliance elements.

As shown in FIG. 7, the circular ramp 45 also includes a lateral lobe 50 to effect closing of an auxiliary switch to operate devices such as pilot lamps, extra elements, fans or safety circuits.

The cam follower 47 is provided in the form of an adjustment screw which threadingly engages in a portion of the bimetallic strip C to enable fine tuning adjustment to the pulse rate.

The bimetallic strip is configured into a U shape with one leg of the "U" forming the bimetal strip shown in FIGS. 5 and 6 and the other leg of the "U" defining a heat compensating portion which is the portion mounting the cam follower 47 shown in FIG. 7. The heat compensating portion acts as a compensator for when heat builds up within the energy regulator, ensuring that the pulses remain constant, irrespective of heat build up. The configuration of the bimetallic strip C can be most clearly seen in FIG. 9.

Figure 8:
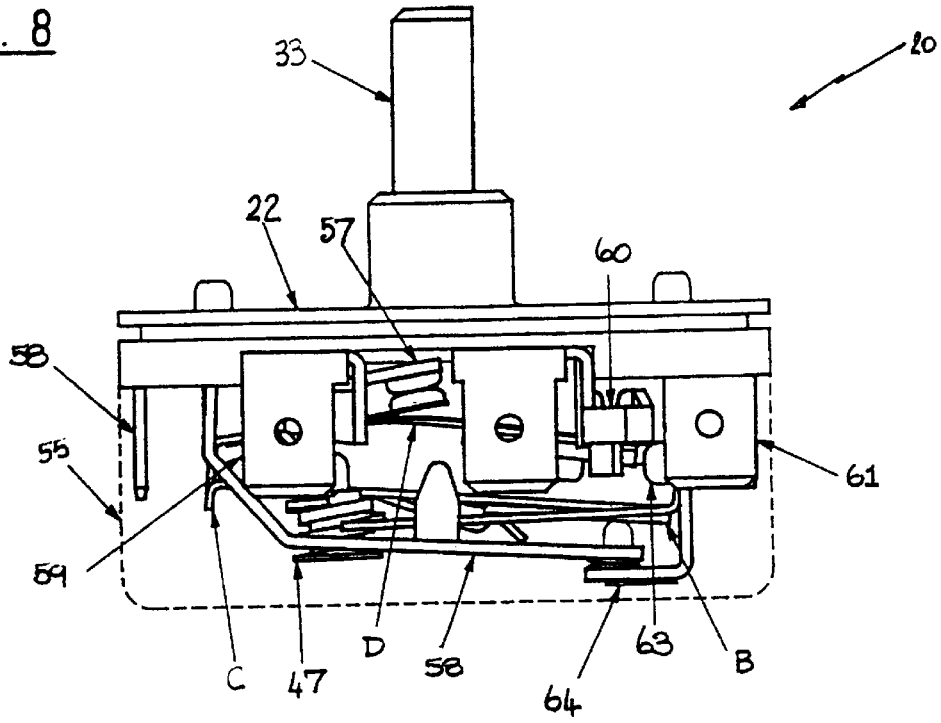
FIG. 8 is a side view of an energy regulator similar to that shown in FIG. 2, but with some slight variations.
Figure 9:
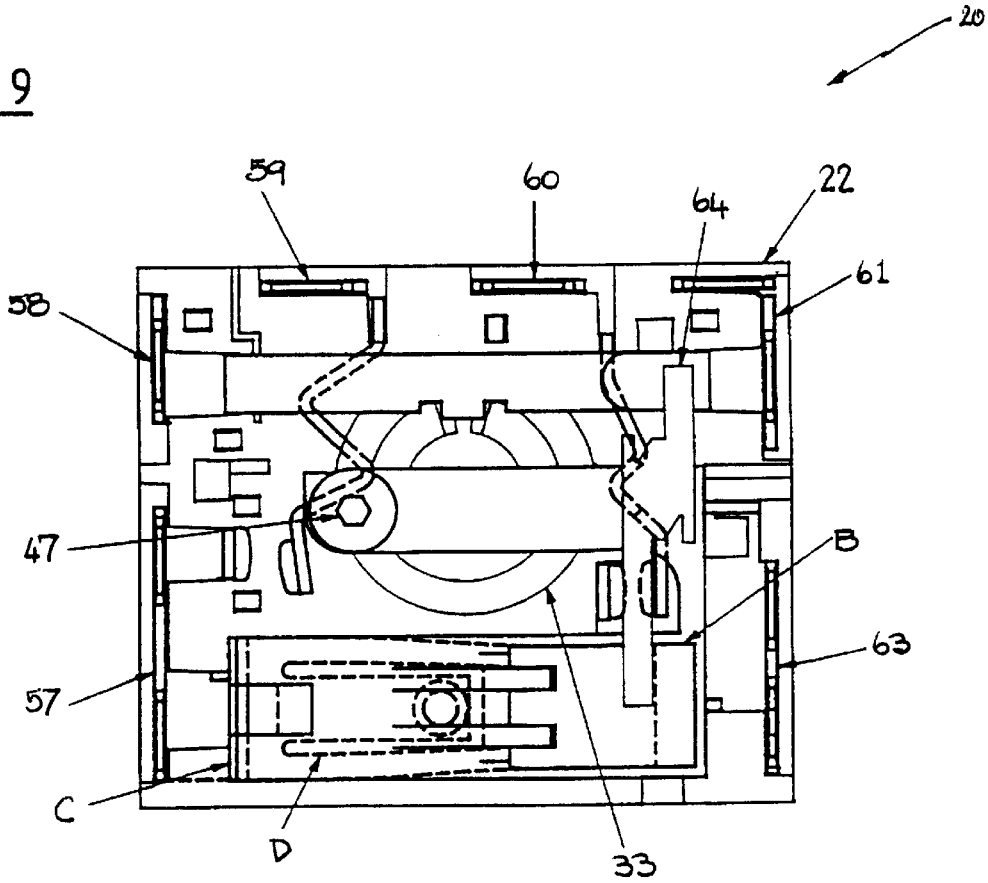
FIG. 9 is an underside view of the energy regulator shown in FIG. 8.

In connection with FIGS. 8 and 9, a detailed description of the components of the energy regulator 20 will now be provided.

Up to this point, the numeral 25 has been used to collectively refer to the electrical terminals. Each of the terminals will now be individually identified in connection with FIGS. 8 and 9.

Component Description

Control Actuator (33)

The control actuator 33 includes a moulded thermoplastic shaft which clips into and rotates in the body portion 22. Rotation of the shaft controls the switching mechanisms in the control device. It opens and closes the separate circuits within the control device. It also adjusts the output of the cycling mechanism by altering the attitude of the Bimetallic Strip C by means of the Cam Ramp 45 on one end. This component can have many forms to allow for many options of shaft size and switching operations. The shaft also provides part of the locking mechanism between it and the body portion 22, for a "Push-to-Turn" option of control operation.

Body Portion (22)

All terminals slide and clip in from sides. The control actuator shaft clips into it. The mounting mechanism of the control shaft is an integral part of the body portion 22. A protective terminal cover 55 also clips onto the body portion 22. This component also provides the second part of the locking mechanism with the control shaft for a "Push-to-Turn" option as described above.

Terminal Cover (55)

Moulded thermoplastic cover. This clips onto the body portion 22 to provide protection for the internal mechanisms of the control. It also incorporates a connecting strip from the neutral terminal to the ceramic heater.

Phase Terminal (57)

Pressed nickel plated steel terminal. This slides and clips into the body portion 22 and provides for two external electrical connection by means of standard ¼" terminals. It provides the connection to the spring member D for the main cycling mechanism of the control. This component also provides for connection to the on-off terminal 59 for a phase break circuit (fill current, used with contacts), or a pilot light circuit (low current, no contacts used). The terminal with the phase/pilot connection can also be separated from the other terminal to provide an isolated circuit with the on-off terminals 59.

Neutral Break Terminal (58)

Pressed nickel plated steel terminal. This slides and clips into the body portion 22 and provides for external electrical connection by means of a standard ¼" terminal. The blade part of this component is operated by the control shaft. It switches the neutral or second phase circuit depending on the application, between it and neutral terminal 61. This component also provides the force required on the control shaft for a "Push-to-Turn" option.

On-Off Terminal (59)

Pressed phosphor bronze terminal. This slides and clips into the body portion 22 and provides for external electrical connection by means of a standard ¼" terminal. The blade part of this component is operated by the control shaft. It is used to switch a phase break circuit, pilot circuit or isolated circuit as described above in connection with the phase terminal 57. This component also provides the detenting (indexing) of the control by operating in depressions on the surface of the control shaft.

Divided Terminal (60)

Pressed phosphor bronze terminal. This slides and clips into the Mounting Plate and provides for external electrical connection by means of a standard ¼" terminal. The blade part of this component is operated by the control shaft. It switches to a connection on the Load Terminal 63 to provide a circuit for a second load.

Neutral Terminal (61)

Pressed nickel plated steel terminal. This slides and clips into base 22 and provides for two external electrical connections by means of standard ¼" terminals. It provides the connection to the neural break terminal 58 for the neutral or second phase circuit. It also provides for contact to the neutral connector 64 to complete the neutral circuit with the Ceramic Heater B.

Spring Member (D)

Pressed titanium copper spring. This component is permanently staked to the load terminal 63 and completes the connection for the main cycling mechanism between the phase terminal 57 and the load terminal 63. The "tongue" of the trident has a contact on it which completes this circuit with the phase terminal 57. Self contained stresses put into this component when forming it provide the "snap action" for the switching of this circuit. The cycling of this circuit is controlled by the heating and cooling of the Bimetallic strip B which moves the end of the spring member up and down, opening and closing the contacts.

Load Terminal (63)

Pressed nickel plated steel terminal. This slides and clips into the body portion 22 and provides for two external electrical connections by means of standard ¼" terminals. This component allows for the permanent staked mounting of the spring member D and the hinged mounting of the bimetallic strip B. It is the second part of the cycling circuit between it and the phase terminal 57. It also provides a connection for switching a second load circuit to the divided terminal 60.

Ceramic Heater (B)

Moulded alumina ceramic with resistive film and silver contacts screened on to its surface. This component clips onto and is electrically connected to the bimetallic strip C at one end. It provides a connection for the neutral connector 64 at the other end to complete a heater circuit between the load terminal 63 and the neutral terminal 61. This component, when energized, provides the heat directly to the bimetallic strip C to make the control cycle.

Bimetallic Strip (C)

Pressed bimetal. This component provides the clip mounting and electrical connection for the ceramic heater B, the screw mounting for the calibration screw 47, the hinge mounting of it to the load terminal 63 and the switching (cycling) of the spring member D. Heat from the ceramic heater 81 causes the bimetallic strip C to bend and relax pressure on the spring member D which allows it to spring open and break the circuit. The bimetallic strip C then cools and eventually returns to its original position causing the spring member D to snap closed again, then the cycle repeats. The output of the control is altered by rotating the control actuator 33 which changes the attitude of the bimetallic strip C.

Cam Follower (47) (Also Used as Calibration Screw)

Moulded thermoplastic screw. This component threads into the bimetallic strip 12. The nose of the screw runs on a cam ramp surface of the end of the control actuator 33 to allow the output of the cycling mechanism to be altered by the rotation of the control actuator. Adjustment of the screw presets the output of the cycling mechanism at predetermined settings of the control actuator.

Neutral Connector (64)

Pressed stainless steel connector. This component fits into the terminal cover 55. It provides electrical connection between the ceramic heater B and the neutral terminal 61 to complete the heater circuit.

What is claimed is:

1. An energy regulator for an appliance comprising:

a body portion;

one or more electrical elements mounted to the body portion, the body portion and at least one of said electrical elements defining an assembly having length, breadth, and thickness dimensions, the thickness dimension being the minimum external dimension of the assembly;

a plurality of electrical terminals mounted in the body portion, at least one of said electrical terminals having a mounting portion and a contact portion, the mounting portion extending transversely to the direction of said thickness dimension and being received in a recess formed in a side of the body portion, which side is substantially parallel to the thickness dimension, the mounting portion being adapted for sliding assembly into the recess;

wherein said contact portion extends substantially parallel to said thickness dimension and does not extend substantially beyond said thickness dimension.

2. The electrical device of claim 1, wherein the mounting portion is substantially planar and is oriented such that the thickness dimension extends substantially perpendicular to the plane of the mounting portion.

3. The electrical device of claim 1, wherein the contact portion of the electrical terminal has a substantially planar contact surface which is substantially parallel with the thickness dimension.

4. The electrical device of claim 1 wherein the terminal is an L-shaped member whereby the mounting portion and the contact portion define respective leg portions of the L-shaped member.

5. The electrical device of claim 1 wherein the contact portion is disposed for contact alongside said side of the body portion.

6. The electrical device of claim 1 wherein the recess is in the form of a slot, which is complementary in shape to the mounting portion of the terminal.

7. The electrical device of claim 1 wherein a frictional fit is provided between the mounting portion of the terminal and the body portion.

8. The electrical device of claim 1 wherein a snap fit is provided between the mounting portion of the terminal and the body portion.

9. The electrical device of claim 1 wherein the body portion is substantially planar.

10. The electrical device of claim 9 wherein a plurality of terminals are provided and the electrical element(s) and the terminals are mounted to extend from the same face of the body portion.

11. The electrical device of claim 10 further including a mechanical rotary control actuator mounted to extend from the other face of the body portion in a direction substantially parallel with the thickness dimension.

12. The energy regulator of claim 1 wherein the body portion is a unitary construction.

13. The electrical device of claim 12 wherein the body portion is comprised of a plastic molded construction.

14. The energy regulator of claim 4 wherein the contact portion is disposed for contact alongside said side of the body portion.

15. The energy regulator of claim 4 wherein the recess is in the form of a slot, which is complementary in shape to the mounting portion of the terminal.

16. The energy regulator of claim 4 wherein a frictional fit is provided between the mounting portion of the terminal and the body portion.

17. The energy regulator of claim 4 wherein a snap fit is provided between the mounting portion of the terminal and the body portion.

18. The energy regulator of claim 4 wherein the body portion is substantially planar.

19. The energy regulator of claim 4 wherein the body portion is a unitary construction.

20. The electrical device of claim 4 further including a mechanical rotary control actuator extending from a face of the body portion in a direction substantially parallel with the thickness dimension.

21. An energy regulator for an appliance comprising:

a body portion, wherein said body portion is substantially planar;

one or more electrical elements mounted to one face of said body portion;

a rotary control actuator mounted to another face of said body portion, wherein the longitudinal axis of said rotary actuator extends substantially transversely to the plane of said body portion;

a plurality of electrical terminals mounted in the body portion free from mechanical contact with make/break contacts, each of said electrical terminals having a mounting portion and a contact portion, the mounting portion extending substantially transversely to the longitudinal axis of said rotary actuator and being received in a recess formed in a side of the body portion, said side being substantially parallel to the longitudinal axis of said rotary actuator, said mounting portion being adapted for slidable receipt into said recess;

said contact portion extending substantially parallel to the longitudinal axis of said rotary actuator; and said one or more electrical element and said plurality of terminals extending from the same face of said body portion.

22. A method for fabricating an energy regulator for an appliance, said method comprising:

providing an assembly having length, breadth, and thickness dimensions, the thickness dimension being the minimum external dimension of said assembly, said assembly including one or more electrical elements mounted to a body portion, said body portion including a plurality of recesses formed in at least one side thereof, said side being substantially parallel to the thickness dimension;

providing a plurality of electrical terminals, each of said terminals including a contact portion and a mounting portion;

selectively inserting each of said terminals into each of said recesses, said mounting portion extending transversely to the thickness dimension, said contact portion being substantially parallel to the thickness dimension and not extending beyond the thickness dimension.

* * * * *